United States Patent [19]

Smith et al.

[11] 4,078,900

[45] Mar. 14, 1978

[54] METHOD OF MAKING A HIGH CURRENT DENSITY LONG LIFE CATHODE

[75] Inventors: Bernard Smith, Neptune; Albert F. Newman, Spring Lake, both of N.J.

[73] Assignee: The United States of America as represented by the Secretary of the Army, Washington, D.C.

[21] Appl. No.: 808,928

[22] Filed: Jun. 22, 1977

[51] Int. Cl.[2] ..... H01J 9/04

[52] U.S. Cl. ..... 29/25.17

[58] Field of Search ..... 29/25.11, 25.17

[56] References Cited

U.S. PATENT DOCUMENTS 3,525,135 8/1970 Bondley ..... 29/25.17 X

*Primary Examiner*—Richard B. Lazarus

*Attorney, Agent, or Firm*—Nathan Edelberg; Jeremiah G. Murray; Roy E. Gordon

[57] ABSTRACT

A high current density long life cathode for use in high power microwave tube applications is made by: machining a porous tungsten pellet with copper in its pores to the desired cathode shape to form the emitting surface of the cathode and cleaning the porous pellet ultrasonically in trichloroethylene, then acetone, and then methanol; firing the tungsten pellet at about 1800° C in a reducing atmosphere; etching the tungsten pellet ultrasonically in a solution of 50 parts of concentrated nitric acid in 50 parts of water; ultrasonically cleaning the tungsten pellet for about five minutes in an aqueous alkaline solution; cleaning the tungsten pellet in hot deionized water and then air drying the tungsten pellet in an oven for five minutes at about 150° C; refiring the tungsten pellet in a reducing atmosphere at about 1800° C; impregnating the porous tungsten pellet with a mixture of $Ba_3WO_6$, $Ba_2SrWO_6$ and $ZrH_2$ in a nonreducing, nonoxidizing atmosphere at about 1900° C to 2000° C; and firing the impregnated tungsten pellet in a reducing atmosphere of dry hydrogen at about 1840° C for about 2 to 5 minutes.

7 Claims, No Drawings

METHOD OF MAKING A HIGH CURRENT DENSITY LONG LIFE CATHODE

BACKGROUND OF THE INVENTION

This invention relates in general to method of making a high current density long life cathode for use in high power microwave tube applications and in particular to such a method in which the emitting surface of the cathode is impregnated with a mixture of $Ba_3WO_6$, $Ba_2SrWO_6$ and $ZrH_2$.

The state of the art in high power microwave tubes has progressed to the point where the major limiting factor in achieving high power, long life operation is the cathode, which is the heart of the device. Of all the cathodes presently under development, the one that has the best reported emission density as a function of temperature is the tungstate cathode in which the active compound of the emitting surface is $Ba_5Sr(WO_6)_2$. This cathode is presently made by pressing the tungstate powder into a pellet and machining the surface of the pellet. Though the cathode made by this method is adequate from an emission standpoint, it has several disadvantages. That is, the cathode shapes that can be made by the pressing method are severely limited due to the requirement that extremely high compaction pressures be used in the fabrication of the emitter. Moreover, the cost per emitter is in excess of $300 per cathode. Then too, the cathodes fabricated by the pressing method are hygroscopic and thus quite sensitive to degradation. This necessitates that after firing in hydrogen at 1840° C, the cathodes made by the pressing method must be cooled and immediately stored in a vacuum. Because of this property, cathodes fabricated by pressing are not conducive to fabrication by low cost production methods.

SUMMARY OF THE INVENTION

The general object of this invention is to provide a method of making a high current density long life cathode for use in high power microwave tube applications. A further object of the invention is to provide such a method that will be economic. A still further object of the invention is to provide such a method in which there will be no limitation as to the shape of the emitter surface of the cathode. Another object of the invention is to provide such a method in which the resulting cathode will not be subjected to degradation. Another object of the invention is to provide such a method that will result in a cathode with an increased emitter life and higher emission as a function of operating temperature. Another object of the invention is to provide such a method that will result in a low cost cathode that will be compatible with high volume state of the art production techniques without requiring special handling.

The foregoing objects have now been attained by impregnating the emitting surface of the cathode with a mixture of $Ba_3WO_6$, $Ba_2SrWO_6$ and $ZrH_2$. More particularly, according to the invention, a porous tungsten pellet with copper in its pores is used as the emitting surface of the cathode and is machined to the desired cathode shape, and then cleaned ultrasonically in methanol. The porous tungsten pellet is then fired at 1800° C in a dry hydrogen atmosphere. Then, the porous tungsten pellet is ultrasonically-etched in a solution of 50 parts of concentrated nitric acid in 50 parts of water. Then, the tungsten pellet is ultrasonically cleaned for about 5 minutes in an aqueous solution of sodium hydroxide. The tungsten pellet is then cleaned in hot deionized water and air dried in an oven for 5 minutes at about 150° C. The tungsten pellet is then refired in a reducing atmosphere at about 1800° C. The tungsten pellet is then impregnated with a mixture of $Ba_3WO_6$, $Ba_2SrWO_6$ and $ZrH_2$ in a nonreducing, nonoxidizing atmosphere at about 1900° C to 2000° C, and then fired in a reducing atmosphere at about 1840° C for about 2 to 5 minutes.

Two of the impregnating materials, $Ba_3WO_6$ and $Ba_2SrWO_6$, can be conveniently obtained as a reaction product mixture of the reaction of barium carbonate with strontium carbonate and tungsten oxide for a minimum of two hours in air according to the reaction:

$$5BaCO_3 + SrCO_3 + 2WO_3 \xrightarrow{1400^\circ C} Ba_3WO_6 + Ba_2SrWO_6 + 6CO_2$$

The resulting mixture of $Ba_3WO_6$ and $Ba_2SrWO_6$ is then mixed with $ZrH_2$ in the ratio of about 4.5 grams of $Ba_3WO_6$ and $Ba_2SrWO_6$ mixture to about 0.200 gram of $ZrH_2$. After ball milling, the resulting mixture is suitable for impregnating the porous tungsten pellet. An amount of the mixture is used that will fully impregnate the porous tungsten pellet.

DESCRIPTION OF THE PREFERRED EMBODIMENT

A 20 percent porous tungsten pellet with copper in its pores and measuring about 3.9 millimeters in diameter and about 2.5 millimeters in thickness is the emitting surface of a cathode formed by heli-arcing or pressing the pellet into a molybdenum sleeve. Copper is present in the pores of the tungsten pellet as a filler material to prevent smearing or closing of the pores during succeeding steps. Moreover, copper does not adversely affect the emission characteristics. The tungsten pellet in this molybdenum sleeve is then machined into a planar shape. After machining, the porous tungsten pellet is cleaned ultrasonically in trichloroethylene, then cleaned ultrasonically in acetone, and then cleaned ultrasonically in methanol.

Next the porous tungsten pellet is fired in a dry hydrogen atmosphere in a furnace at 1800° C to remove contaminants and copper filler material in the pellet.

After cooling, the porous tungsten pellet is etched ultrasonically in a solution of 50 parts of concentrated nitric acid in 50 parts of water for one hour. This step serves to remove any copper residue left from the firing in hydrogen, and also serves to increase the volume available for impregnation with the active material. This increases the overall emitter life as the emitter life is a function of temperature and the amount of active material available at the given porosity.

The porous tungsten pellet is then ultrasonically cleaned in an aqueous solution of 40 parts sodium hydroxide in 60 parts of water. The porous tungsten pellet is then ultrasonically cleaned in hot deionized water to remove any acid or salt compounds and then ultrasonically cleaned in acetone and then methanol to remove remaining water. The pellet is then air dried in an oven at about 150° C for 30 minutes.

Then, the porous tungsten pellet is refired in hydrogen at 1800° C.

Then, the emitter is impregnated with about 4.5 grams of a mixture of $Ba_3WO_6$ and $Ba_2SrWO_6$ and about 0.2 gram of $ZrH_2$ in a nonreducing, nonoxidizing atmosphere of argon. That is, the active mixture is placed on the surface of the porous tungsten pellet. Then, the pellet is fired at about 1900° C to 2000° C to melt the tungstate so that it flows into the tungsten pellet by gravitational action.

After firing, any excess impregnating material which remains on the surface can be removed by a light brushing of the surface with a suitable brush as, for example, a camel hair brush. The pellet is then fired in dry hydrogen at 1840° C for 2 to 5 minutes.

If a residue remains on the surface of the cathode at this point, a light cut may be made on the cathode surface. When a light cut is made, care must be taken not to cause smearing of tungsten over the porous areas. With or without the final cut, the cathode is ready for mounting and activation.

The cathode is capable of emission densities from 50 milliamperes per square centimeter up to 40 amperes per square centimeter at temperatures of 600° C to 1150° C. The cathode can be used in a wide variety of microwave tubes which require thousands of cathodes such as in phased-array radar and in high power travelling wave tubes. The cathode also has a significant enonomic advantage in view of the increased tube life, the reduced maintenance cost per system as a result of tube failure, and the lower cost per tube thus reducing overall system cost.

In the method of the invention, the porous tungsten pellet emitter after impregnating can be processed by itself or after heli-arcing or pressing into a sleeve of a nonporous heat conducting metal such as molybdenum, tungsten, or tantalum. The pores of the porous tungsten pellet before impregnating contain a filler metallic material such as copper that does not adversely affect the emission characteristics.

It should be noted that the cathode size may be varied as desired. In such variations, all that is required is that the proportionate ratio of active material to the volume of the porous pellet be maintained.

The porous tungsten pellet is commercially available in rod or bar form in a wide range of porosities. The range of porosities of the tungsten pellet can be varied from 11 percent porosity to 28 percent porosity. Generally, the lower the porosity, the less the amount of active material needed for impregnation. The higher the porosity, the greater the amount of material that can be used for impregnation.

We wish it to be understood that we do not desire to be limited to the exact details described, for obvious modifications will occur to a person skilled in the art.

We claim:

1. Method of making a high current density long life cathode for use in high power microwave tube applications said method including the steps of:

(a) machining a porous tungsten pellet having a porosity ranging from about 11 percent to about 28 percent with copper in its pores to the desired cathode shape to form the emitting surface of the cathode and cleaning the porous pellet ultrasonically in trichloroethylene, then acetone, and then methanol, (b) firing the tungsten pellet at about 1800° C in a reducing atmosphere, (c) etching the tungsten pellet ultrasonically in a solution of 50 parts of concentrated nitric acid in 50 parts of water, (d) ultrasonically cleaning the tungsten pellet for about five minutes in an aqueous alkaline solution, (e) cleaning the tungsten pellet in hot water and then air drying the tungsten pellet in an oven for five minutes at about 150° F, (f) refiring the tungsten pellet in a reducing atmosphere at about 1800° C, (g) impregnating the porous tungsten pellet with a mixture of $Ba_3WO_6$, $Ba_2SrWO_6$ and $ZrH_2$ in a nonreducing, nonoxidizing atmosphere at about 1900° C to 2000° C, and (h) firing the tungsten pellet in a reducing atmosphere at about 1840° C for about 2 to 5 minutes.

2. Method according to claim 1 wherein the reducing atmosphere in steps (b), (f) and (h) is dry hydrogen.

3. Method according to claim 1 wherein the nonreducing, nonoxidizing atmosphere in step (g) is argon.

4. Method according to claim 1 wherein the mixture of $Ba_3WO_6$, $Ba_2SrWO_6$ and $ZrH_2$ in step (g) is used in an amount to fully impregnate the porous tungsten pellet.

5. Method according to claim 1 wherein the porous tungsten pellet with copper in its pores in step (a) measures about 3.9 millimeters in diameter and about 2.5 millimeters in thickness and has a porosity of about 20 percent, and wherein the mixture of $Ba_3WO_6$, $Ba_2SrWO_6$ and $ZrH_2$ in step (g) is in the ratio of about 4.5 grams of $Ba_3WO_6$ and $Ba_2SrWO_6$ to about 0.2 gram of $ZrH_2$.

6. Method according to claim 2 wherein the porous tungsten pellet with copper in its pores in step (a) measures about 3.9 millimeters in diameter and about 2.5 millimeters in thickness and has a porosity of about 20 percent, and wherein the mixture of $Ba_3WO_6$, $Ba_2SrWO_6$ and $ZrH_2$ in step (g) is in the ratio of about 4.5 grams of $Ba_3WO_6$ and $Ba_2SrWO_6$ to about 0.2 gram of $ZrH_2$.

7. Method according to claim 3 wherein the porous tungsten pellet with copper in its pores in step (a) measures about 3.9 millimeters in diameter and about 2.5 millimeters in thickness and has a porosity of about 20 percent, and wherein the mixture of $Ba_3WO_6$, $Ba_2SrWO_6$ and $ZrH_2$ in step (g) is in the ratio of about 4.5 grams of $Ba_3WO_6$ and $Ba_2SrWO_6$ to about 0.2 gram of $ZrH_2$.

* * * * *